US007146887B2

(12) United States Patent
Hunter

(10) Patent No.: US 7,146,887 B2
(45) Date of Patent: Dec. 12, 2006

(54) AUTOMATIC SIZING ONE-HANDED LOCKING PLIERS

(76) Inventor: Robert Evan Hunter, 221 Wrightsman, Virden, IL (US) 62690

( * ) Notice: Subject to any disclaimer, the term of this patent is extended or adjusted under 35 U.S.C. 154(b) by 66 days.

(21) Appl. No.: 11/052,509

(22) Filed: Feb. 7, 2005

(65) Prior Publication Data

US 2006/0174734 A1 Aug. 10, 2006

(51) Int. Cl.
*B25B 7/12* (2006.01)

(52) U.S. Cl. ..... 81/367; 81/368; 81/373

(58) Field of Classification Search ..... 81/367, 81/368, 373, 374, 375, 370, 377, 380
See application file for complete search history.

(56) References Cited

U.S. PATENT DOCUMENTS

| | | | | |
|---|---|---|---|---|
| 2,496,309 | A * | 2/1950 | Pugh | 81/380 |
| 3,496,808 | A * | 2/1970 | Schmidt | 81/370 |
| 3,545,316 | A * | 12/1970 | Patrick | 81/368 |
| 3,710,658 | A * | 1/1973 | Wilson | 81/367 |
| 5,056,385 | A * | 10/1991 | Petersen | 81/370 |
| 5,435,214 | A | 7/1995 | Sisson | |
| 6,095,019 | A | 8/2000 | Warheit | |
| 6,591,719 | B1 | 7/2003 | Poole | |
| 6,708,588 | B1 * | 3/2004 | Kesinger et al. | 81/380 |
| 2005/0279195 | A1 * | 12/2005 | Hile | 81/368 |

* cited by examiner

*Primary Examiner*—Lee D. Wilson
*Assistant Examiner*—Alvin J. Grant
(74) *Attorney, Agent, or Firm*—Haverstock, Garrett & Roberts LLP

(57) ABSTRACT

An automatically adjustable locking pliers includes an upper jaw fixed to a handle and lower jaws that pivot about the handle. The lower jaws are connected to a lower tightening handle. A lever connects the tightening handle and upper body. This is the standard structure of locking pliers well known in the industry. The improvement includes a self-adjusting sizing and locking mechanism A thumb jaw sizing lever is located near the jaws and may be moved to open the jaws so that they can be sized around a workpiece. When the thumb jaw lever is released, the jaws automatically size and clamp lightly around the workpiece. The sizing lever and locking mechanism operate together to automatically size and lock the pliers. An adjusting screw in the lower handle near a pivot point sets the clamping force. Turning the screw adjusts the tension of the pliers for gripping the workpiece.

6 Claims, 3 Drawing Sheets

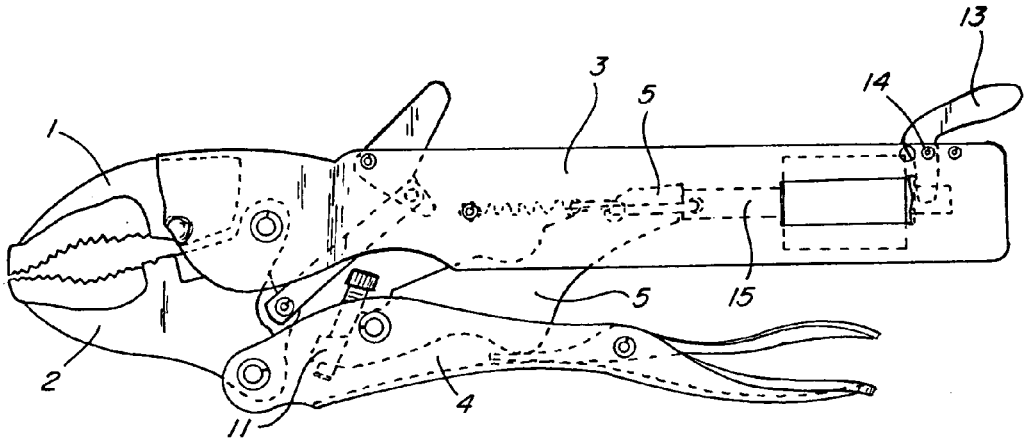
Fig. 2
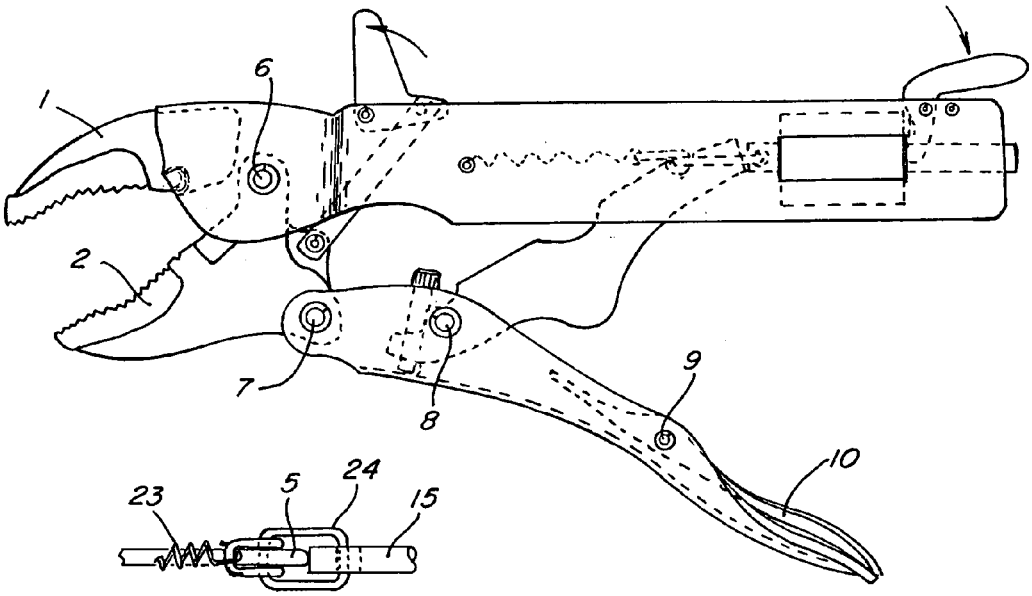
Fig. 3
Fig. 1

AUTOMATIC SIZING ONE-HANDED LOCKING PLIERS

BACKGROUND OF THE INVENTION

This invention relates to the field of tools for mechanical work. More particularly, an automatically sized one-handed locking plier is presented.

Locking pliers have been sold in their standard form for decades with little significant improvements. While the pliers perform wonderfully and are a staple in every toolbox around the world, certain improvements would make the locking pliers even more useful. Locking pliers differ from ordinary pliers in that they contain a mechanism to lock the jaws of the pliers onto the work piece. Many different types of locking pliers have been produced, and they are commonly known in the trade as Vise-Grips® or simply "locking pliers."

Some of the problems with locking pliers include the fact that they are tedious in use, since iterative screw adjustments must be made to size the jaws to the part.

Pliers that can be easily operated with one hand and that automatically size the jaws to the part, but still provide the quality and clamping force of the standard locking pliers, would provide an advancement in the ease of use and utility of the pliers.

Examples of useful locking plier tools are found in various United States patents of general interest in the field.

One good example of a locking plier tool is found in the 2000 United States patent issued to Warheit, U.S. Pat. No. 6,095,019. Warheit discloses the typical locking plier tool used to clamp onto a work piece. The Warheit device has a thumb actuated control member which facilities work piece pressure adjustment and tool release by one hand. The typical locking pliers, as shown in the patent issued to Warheit and other US patents, include an upper jaw that is permanently attached to an elongated body. A lower jaw is pivotably attached to the locking pliers as well as a lower handle tightening mechanism. A pivoting lever normally connects the upper body and lower tightening mechanism. The pliers are usually tightened for work piece sizing and for grip strength by a thumbscrew mechanism, generally found at the end of the upper body handle.

Several problems have been encountered in the use of previous tools and improvements could prove beneficial. One such problem is that while the tools must be sized to fit the work piece, the sizing is usually done by a thumbscrew mechanism that requires both hands to operate the mechanism. One hand is needed to hold the locking pliers onto the work piece while the other hand is needed to turn the thumbscrew adjustment. It is a primary object of this invention to provide a locking plier type of hand tool that automatically sizes the jaws of the locking pliers onto the work piece.

Another problem with the locking pliers heretofore known in the art is that the sizing of the pliers onto the work piece has a direct correlation to the hand pressure or gripping pressure used to lock the pliers onto the piece. Once the pliers have been sized approximately, a further manipulation of the adjusting thumbscrew would be necessary to adjust the handle grip strength. It is another object of this invention to provide a locking plier that not only automatically sizes the jaws to the workpiece, but also has an adjustment screw, operable by the same hand that holds the pliers, for adjusting the handgrip strength to a set handgrip for each workpiece.

Another major drawback in the use of ordinary locking pliers is that the handgrip strength tensioning mechanism and the sizing mechanism require both hands of the mechanic. Since both hands are needed to attach and tighten the pliers to the workpiece, the task of adjusting the locking pliers is both cumbersome and time consuming. It is a still further object of this invention to provide a locking pliers wherein the use of the pliers is conveniently and quickly accomplished so that the workman uses little or no time when changing from one work piece to another.

A final aspect of this invention allows the locking plier to remain loosely gripped around the work piece when the pliers have been released into their open position. This is a particularly useful feature of the locking plier mechanism of the instant invention since it allows the workman to remove the wrench, with one hand, at the workman's convenience. This feature eliminates the wrench falling on the workman if he is an awkward position.

Other and further objects of this invention will become obvious upon reading the below described specification.

BRIEF DESCRIPTION OF THE DEVICE

The locking pliers device described has the basic structure of a locking pliers, including an upper fixed jaw connected to an upper body handle and a lower pivoting jaw connected to the upper handle by a middle lever. A lower pivoting handle is connected to the middle lever and the lower jaw. An improvement to existing locking pliers includes an adjusting screw-type mechanism that is placed near the pivot point between the lower handle and middle lever to adjust the grip strength (or clamping force) of the locking pliers. Within the upper body handle is another improvement, a workpiece automatic sizing and locking mechanism. The unique locking mechanism includes a tapered metal housing containing ball bearings that surround a locking rod (or plunger). The locking rod is spring biased towards the jaws and may be locked in place when the ball bearings are forced against the outer surface of the rod. The locking rod abuts the middle lever and pushes against it. A palm handle, located at the end of the body of the locking pliers, allows to the workman to release the locking rod by pushing the palm handle downwards. A thumb operated sizing lever is also located within the upper body and is connected by a linkage to the lower jaw. The pliers are sized and locked to a workpiece by opening the spring-loaded jaws with the thumb lever, releasing the thumb lever, and squeezing the lower handle towards the upper body. The thumb lever and locking rod automatically adjust the jaw size and lock the pliers to the workpiece. The lower paddle releases the laws, but they remain lightly closed on the workpiece until the workman opens them by pushing on the thumb lever.

BRIEF DESCRIPTION OF THE DRAWING FIGURES

FIG. 1 is a side view of the locking pliers shown with the jaws in the open position.

FIG. 2 is a side view of the locking pliers showing the pliers in the closed position.

FIG. 3 is a top view of the adjusting rod and biasing spring linkage.

DETAILED DESCRIPTION OF THE INVENTION

Figure 4:
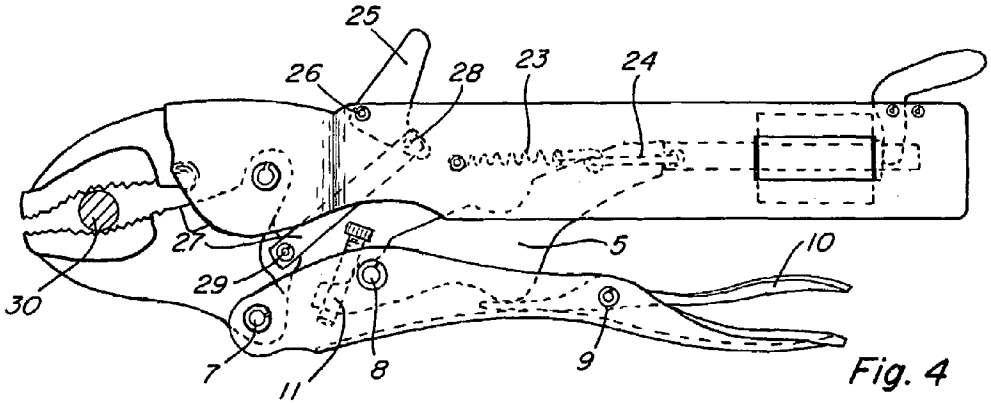
FIG. 4 is a side view of the locking pliers showing it in its closed and locked position around a work piece.

This invention has, generally, the outward appearance and general structure of an ordinary type of locking pliers. The basic structure of the invention includes a fixed permanent jaw 1 permanently attached to an elongated upper body handle 3, as best shown in FIG. 1. Pivotably connected to the fixed upper jaw and body handle is a rotating lower jaw 2. Attached to the lower pivoting jaw 2 is a lower pivoting handle 4. The lower pivoting handle 4 is connected to the upper body handle 3 by a middle lever 5. The middle lever 5 is irregularly shaped as shown in the drawing figures.

In order for this locking plier to function in a unique fashion, a number of pivot points are required. The lower jaw is connected to the upper jaw at pivot point 6. The lower jaw and the lower handle are connected at pivot point 7. The lower handle and middle lever are connected at pivot point 8. The lower handle also has a lower release paddle 10. This lower release paddle 10 is connected to the lower handle at lower paddle pivot point 9. In common use, one places the jaws 1 and 2 around the workpiece and pulls upwardly on the lower pivoting handle 4. This presses the middle lever 5 upward into the upper body handle 3 and locks the jaws onto the workpiece. While this structure is common in the art, the basic structure of the locking pliers has been improved with the addition of the below described components.

A grip strength, or clamping force, adjusting screw 11 is located at the bottom portion of the middle lever 5 as best shown in drawing FIGS. 1 and 4. This grip-tension adjusting screw 11 is threaded into the lower part of the middle lever 5 and extends downwardly from the middle lever to the lower inner surface of the lower pivoting handle 4 at a tightness that is predetermined by the workman. The tightness between the lower handle 4 and the adjusting screw 11 determines the grip strength, or clamping force, required to lock the jaws on the workpiece. The tighter the screw is adjusted against the lower surface of the lower handle 4, the easier it is to tighten the pliers, that is, the lighter the gripping force. The looser the screw is adjusted, the heavier the gripping force.

The locking and sizing mechanisms of the adjustable pliers described herein allow the jaws of the pliers to automatically size themselves to the workpiece. This is a key and most unique feature of this invention.

The locking mechanism is located at the end of the upper body handle away from the jaws. This free end of the upper body handle contains a palm lever 13 as shown in FIG. 2. This palm lever 13 is pivotably connected to the free end of the upper body handle at pivot point 14, as shown on FIG. 6. The palm lever releases the jaws from the workpiece as will be described later.

Figure 6:
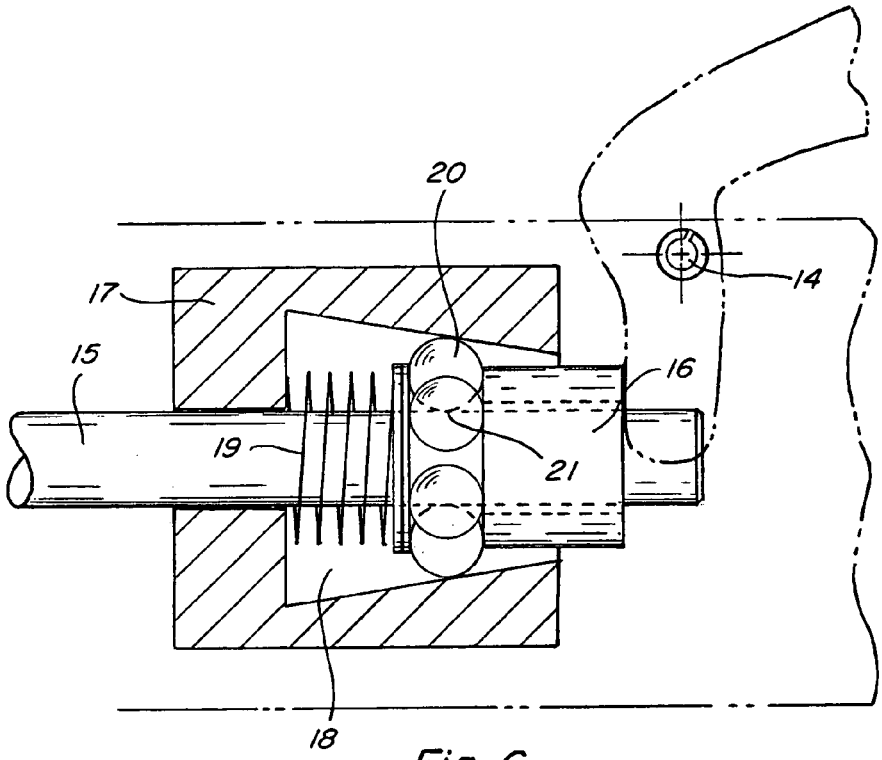
FIG. 6 is an expanded cross sectional view of the workpiece locking mechanism shown in its locked position.
Figure 7:
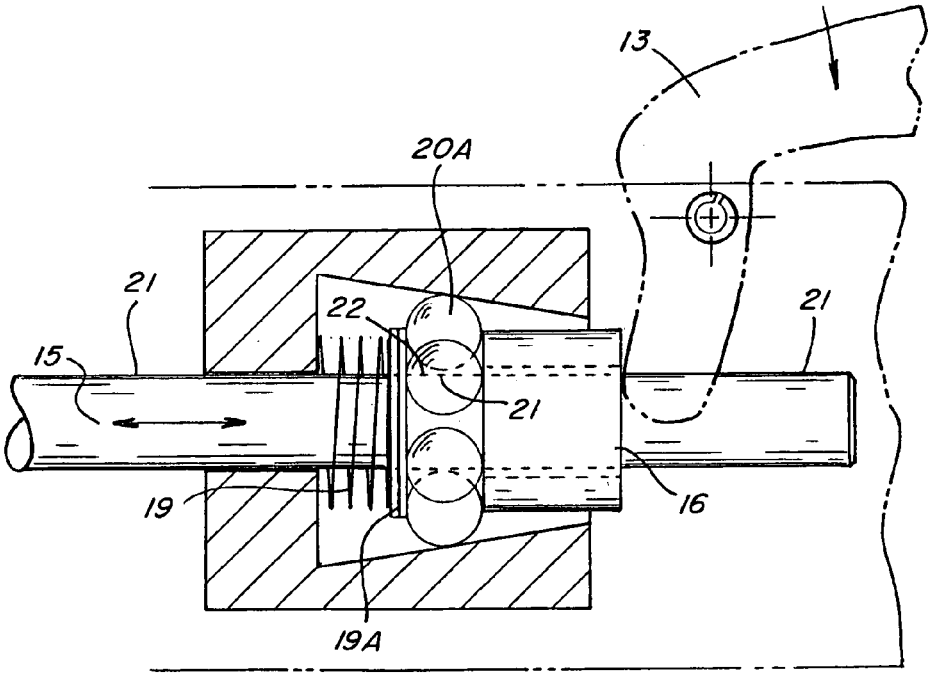
FIG. 7 is an expanded cut-away view of the workpiece locking mechanism shown in its unlocked position.

Turning to Drawing FIGS. 6 and 7, the locking mechanism is shown. The locking mechanism has a horizontal locking rod 15. This adjusting rod slides within a sleeve 16. The locking rod 15 slides through the tapered tightening walls 17. The tapered tightening walls consist of a solid structure containing a tightening chamber 18. It is essential to this invention that the tightening chamber 18 have the trapezoidal inner configuration as shown in FIGS. 6 and 7. The inner tightening chamber 18 slopes downwardly towards the free end and away from the jaw end of the locking pliers. Located within the tightening chamber 18 are a number of bearings 20. The bearings 20 are biased towards the free end of the upper body handle 3 and away from the jaw end by tension spring 19. The tensioning spring 19 may also have tensioning spring washers 19A that would be in direct contact with the ball bearings 20.

The locking rod 15 has an upper rod surface 21. This upper rod surface 21 has an end that protrudes out of the locking mechanism and towards the jaws, and an end that protrudes out of the locking mechanism and towards the free end of the locking pliers. The locking rod 15 moves towards the jaws or away from the jaws as shown in the arrow on FIG. 7.

In order to lock the rod 15 in a position such that the jaws may lock around a workpiece, the bearings 20 must be in contact with the rod surface 21 and the walls of the tightening chamber 18, as shown in the locked position in FIG. 6. As can be seen from FIG. 6, when the bearings 20 are locked between the surface 21 of the rod and the walls of the tightening chamber 18, due in part to the force of the tension spring 19, the rod will not move.

In order to release the jaws, one releases the bearings from the surface of the rod. To accomplish this release, one simply depresses the palm lever 13. Depressing the palm lever 13 moves the adjusting sleeve 16 from right to left on the drawing figures. This action depresses the spring 19 and moves the ball bearings 20 from right to left on the drawing figures. The locking chamber tapers downwardly towards the free end of the handle. Since the locking chamber 18 has a trapezoidal shape as shown, the balls release from the rod when the palm handle 13 is depressed. The locking rod 15 is then allowed to move freely within the sleeve 16 and locking walls 17.

When the jaws are unlocked they can be released from the workpiece. As best shown in FIG. 7, when ball bearings 20A are separated from the surface 21 of rod 15, the separation 22 allows the rod to move from left to right as shown in FIG. 7. While the jaws remain lightly gripped around the workpiece, they can be easily removed from the workpiece by the thumb lever 25 once the locking mechanism has been released as described above.

The workpiece locking rod 15 has one end free, located away from the jaws as shown in FIG. 4. A locking rod biasing spring 23 has one end connected inside the upper body handle 3 and another end connected to the jaw end of the locking rod 15 by a linkage mechanism. This linkage mechanism is best shown in FIG. 3.

As shown in FIG. 3, the jaw end of the locking rod 15 is connected to the linkage 24. The linkage 24 is also connected to the tightening biasing spring 23. The tensioning rod 15 is in contact with and abuts the upper end of the middle lever 5. While the locking rod 15 and lever 5 are in contact, they are not pivotably connected but are rather slidably and rotatably in contact with each other as shown in FIG. 3. The biasing spring 23 biases the locking rod towards the jaw end of the pliers as shown in FIGS. 3 and 4.

Another important aspect of this device is the automatic adjustment of the jaws to the outside dimension of the workpiece. The design of the pliers as described herein allows the user to automatically size the jaws to the workpiece with one hand. The locking mechanism and the sizing mechanism cooperate together to accomplish this.

A sizing thumb lever 25 operates to open the spring-loaded jaws for placement around the workpiece. Releasing the thumb lever then allows the jaws to clamp to the part. The jaws are automatically sized. This automatic sizing mechanism is best shown in FIG. 4.

As shown in FIG. 4, a thumb jaw sizing and release lever 25 has the shape of a boot. This thumb jaw lever 25 is pivotably connected to the upper body handle at the boot heel at pivot point 26. The thumb jaw lever 25 is also connected to a thumb jaw release and lower jaw linkage 27. This lower linkage 27 is pivotably connected to the toe end of the boot 25 at pivot point 28. The lower end of the jaw linkage 27 is pivotably connected to the lower jaw at pivot point 29. Once the pliers are unlocked, as shown in FIG. 1, the thumb jaw release lever 25 is pushed forward (in the embodiment as shown in FIG. 4). The linkage 27 then pulls the lower jaw 2 open to release the workpiece 30 completely.

As shown in FIG. 4 the work piece 30 can be a circular steel rod. Alternatively, the work piece could be a hex nut, a screw, a pipe, or any other type of work piece commonly encountered in the field. When the user pushes the thumb jaw sizing and release lever 25 towards the jaw end of the locking pliers, the spring-loaded jaws open. When the thumb lever is released, the jaws clamp lightly onto the part until the pliers are locked.

Once the locking pliers have been locked onto a workpiece 30, they may be released by depressing the lower release paddle 10 downwardly towards the lower pivoting handle 4. The release paddle 10 pivots about pivot point 9. The jaw end of the release paddle 10 comes into contact with the irregularly shaped humped portion of the middle lever 5, as shown on FIG. 4. This middle lever 5 is then forced upwardly and toward the jaw end of the pliers. This motion releases the upper and lower jaws. However, unlike the standard type of locking pliers currently in use the spring-loaded jaws remain lightly closed on the part until the user opens them by pulling back the thumb jaw release 25 as described above.

Once the jaws have been automatically sized and clamped to the part, the pliers act similarly to other locking pliers in that squeezing the lower handle towards the upper main body creates the clamping force and locking of the pliers. However, the clamping force required to lock the pliers may be preset by the user and can be adjusted through turning the adjusting screw 11, as previously described. This adjustment of the clamping force by the adjustment of one dedicated screw is unique to the locking pliers art. In normal locking pliers, one screw adjusts both the clamping force and also sizes the jaws.

Figure 5:
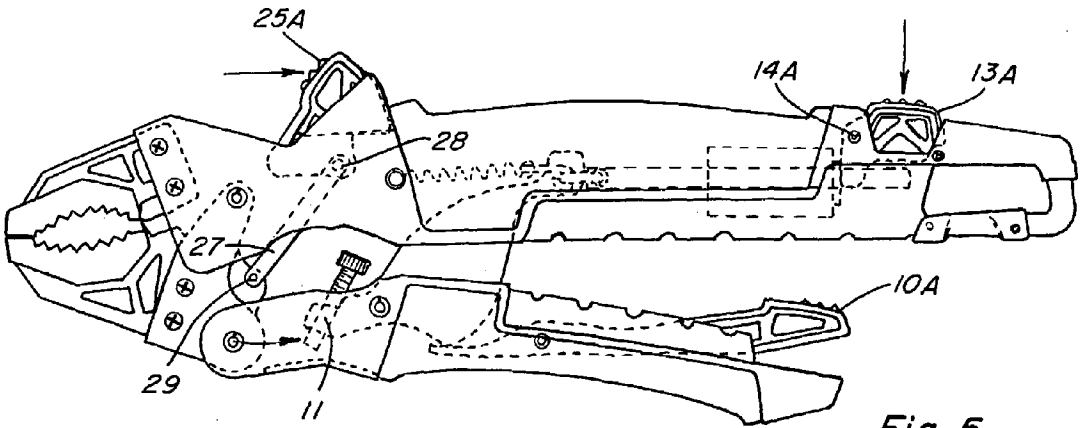
FIG. 5 is a side view of the locking plier in an alternate embodiment showing slightly different palm handle and thumb lever mechanisms.

An alternate embodiment of the device in shown in FIG. 5. In this alternate embodiment, the L shaped palm lever 13 of the embodiment shown in FIG. 4 is replaced with a palm button 13A. The main difference between the two pieces 13 and 13A is that the palm piece 13A, shown in FIG. 5, is flat and is more ergonomically designed.

Another difference in the second embodiment is the use of an alternate thumb jaw piece 25A. In place of the pivoting boot 25, shown in the embodiment of FIG. 4, a sliding thumb jaw piece 25A is provided. The alternate thumb jaw piece 13A moves upwardly when the user slides the thumb jaw piece 25A upwardly. This action moves the linkage 27 upward, which opens the lower jaw 2. The thumb jaw piece 25A is designed to be pulled upward on a slant as shown in FIG. 5.

Alternatively, a second thumb jaw piece pivot could be provided such that the thumb jaw piece pivots when the piece 25A is depressed by the user's thumb. Depressing the piece 25A would pull the linkage 27 upwards, releasing the lower jaw.

In the embodiment in FIG. 5, a more ergonomically designed lower release paddle 10A also replaces the standard release paddle 10. While the second, alternate embodiment shown in FIG. 5 has the above slight modifications, the main and essential parts of the device remain the same in both embodiments.

The locking mechanism described in this application is not unique only to locking pliers, but could also be integrated into other tools such as crescent wrenches, channel locks, pipe wrenches, or other types of wrenches that may be locked. The mechanism disclosed herein can be applied to the entire pliers line with the various jaws fit to a standard body. This high quality and innovative tool could render the existing locking pliers obsolete and become the new standard locking device in every tool box for years to come.

DECISION OF THE REFERENCES

Reference A: Warheit

Warheit discloses a locking plier tool that has a thumb actuated control member that facilitates work piece pressure adjustment with one hand. The mechanism of Warheit is best seen in FIG. 3. While Warheit is a one-hand locking plier tool, it does not have the self-adjusting sizing and locking jaw mechanism or the one hand release mechanism of the present invention.

Reference B: Sisson

Sisson disclosed an adjustable locking plier with a fixed jaw and a moveable jaw. Sisson has a connecting rod between the moveable jaw and the lower locking lever. The locking lever permits the moveable jaw to be locked in a desired position relative to the fixed jaw. The threaded member is adjustable to adjust the locking position of the pivotable jaw. Sisson is the typical locking pliers using a thumbscrew (76 and 78) to adjust the tension of the pliers. Sisson is of general interest in the field.

Reference C: Kesinger

Kesinger discloses a locking plier using friction palls that slide along a support rod and are moved by a push link working against a spring. The push link bears against the center of the friction palls and remain free to slide along the rod. The palls cause the rod to tilt coupling to the rod and preventing movement along the rod. Kesinger is of interest because it describes a self-adjusting mechanism for a locking plier. However, Kesinger uses a tilt mechanism rather than the trapezoidal mechanism with the ball bearings to lock the rod in place as in the instant device. Kesinger has no automatic palm release as in the present device nor does it have a thumb release and cooperating mechanism to automatically size the jaws.

Reference D: Poole

Poole describes an adjustable pliers wrench that has a reciprocal and canting movement. Poole has an adjusting mechanism with a screw 42 but that mechanism operates in a different manner and on different pieces from the instant device. Poole is of general interest in the field, particularly FIG. 2, and shows the general mechanism of an adjustable wrench.

Having fully described my device, I claim:

1. In an adjustable locking pliers having an upper jaw fastened to a main body, and a lower jaw pivotably attached to said main body by a middle lever, the improvement comprising a workpiece locking mechanism means comprising a locking rod biased towards said jaws and slidably received within a tapered chamber such that it may be locked or slidably released, said rod in contact with the upper end of said middle lever, wherein said locking rod may be released by a palm lever.

2. An adjustable locking pliers as in claim 1, wherein said rod may be locked by bearings contained in a trapezoidal chamber tapered downwardly away from the jaw end of said device, said bearings biased towards the smaller end of said chamber by a spring.

3. An adjustable locking pliers as in claim 2, further comprising a sleeve surrounding said rod, wherein said palm lever may be pivoted against said sleeve to force said bearings toward the larger end of said trapezoidal chamber.

4. In an adjustable locking pliers having an upper jaw fastened to a main body, and a lower jaw pivotably attached to said main body by a middle lever, the improvement comprising an automatic size adjusting means comprising:

(1) a workpiece locking mechanism means comprising a locking rod biased towards said jaws and slidably received within a tapered chamber such that it may be locked or slidably released, said rod in contact with the upper end of said middle lever, wherein said locking rod may be released by a palm lever; and (2) a thumb actuated jaw sizing and release lever connected to the lower pivoting jaw of said device by a linkage wherein the movement of said thumb release increases the jaw size of said pliers and releasing said thumb release sizes the jaws to a workpiece.

5. An adjustable locking pliers as in claim 4, wherein the upper end of said linkage is pivotably connected to said thumb release and the lower end of said linkage is pivotably connected to said lower jaw.

6. In an adjustable locking pliers having an upper jaw fastened to a main body, and a lower jaw pivotably attached to said main body by a middle lever, the improvement comprising a grip-tension adjusting screw threadedly attached to the lower end of said middle lever, wherein said screw may be turned to adjust the grip force necessary to lock the pliers and the force applied to the workpiece.

* * * * *